US005265636A

United States Patent [19]

Reed

[11] Patent Number: 5,265,636

[45] Date of Patent: Nov. 30, 1993

[54] FLUIDIC RECTIFIER

[75] Inventor: Jay L. Reed, Oviedo, Fla.

[73] Assignee: Gas Research Institute, Chicago, Ill.

[21] Appl. No.: 2,851

[22] Filed: Jan. 13, 1993

[51] Int. Cl.[5] ..... F17D 1/00; F15C 1/12

[52] U.S. Cl. ..... 137/14; 137/814; 137/826; 137/833

[58] Field of Search ..... 137/820, 821, 833, 826, 137/814, 14, 1

[56] References Cited

U.S. PATENT DOCUMENTS

| | | | |
|---|---|---|---|
| 1,021,742 | 3/1912 | Moore . | |
| 3,204,652 | 9/1965 | Bauer | 137/826 |
| 3,444,879 | 5/1969 | McLeod, Jr. | 137/814 |
| 3,474,805 | 10/1969 | Swartz | 137/821 |
| 3,552,414 | 1/1971 | Sutton | 137/821 |

*Primary Examiner*—A. Michael Chambers
*Attorney, Agent, or Firm*—Speckman, Pauley & Fejer

[57] ABSTRACT

A single-stage and multiple-stage fluidic rectifier wherein each stage has a trunk channel and a reversing channel that joins the trunk channel at a downstream position of the trunk channel, downstream with respect to fluid flowing in a reverse direction through the fluidic rectifier. A first vena contracta is formed upon entry of the fluid into the body, when the fluid is flowing in the reverse direction. Further vena contractas are formed within the trunk channel of each corresponding stage, preferably by flow through the reversing channel being discharged and impinged upon flow through the trunk channel. Such discharged flow from the reversing channel contracts the flow through the trunk channel at a particular area. When fluid flows through the fluidic rectifier in a forward direction, each vena contracta is disabled. Thus in the forward direction, the overall head loss of the fluidic rectifier is less than the overall head loss of the fluidic rectifier when the fluid is flowing in the reverse direction.

34 Claims, 11 Drawing Sheets

FLUIDIC RECTIFIER

BACKGROUND OF THE INVENTION

1. Field of the Invention

This invention relates to a single-stage and a multiple-stage fluidic rectifier wherein each stage of the rectifier has a trunk channel and a reversing channel. In a reverse flow direction, a first vena contracta is formed when fluid enters the trunk channel through a sharp edge orifice. At least one second vena contracta is formed within at least one downstream trunk channel by flow through a reversing channel being discharged into the downstream trunk channel such that the discharged flow from the reversing channel impinges upon and contracts fluid flow through each trunk channel.

2. Description of Prior Art

Conventional apparatuses that act as fluid diodes are known to have no moving parts. However, such conventional apparatuses with no moving parts do not operate with trunk channels and reversing channels to form vena contractas at an entry of fluid into the apparatus and throughout each stage of the fluidic diode.

Tesla, U.S. Pat. No. 1,329,559 discloses a valvular conduit which allegedly offers virtually no resistance to the passage of fluid in one direction, other than surface friction, but is an almost impossible barrier to flow in the opposite direction. At an initial glance, FIG. 1 of the Tesla patent appears to teach the invention of this patent application. However, upon further study it will become apparent that the invention taught by this specification has dominating features and significant improvements which would not be obvious in view of the teachings of the Tesla patent, particularly when taken in view of the technical opinions of recognized authorities in fluid mechanics. The invention described in this specification and the claims produces unexpected results which significantly increase the overall head loss ratio of a single-stage or multiple-stage fluidic rectifier.

At page 1, lines 100–106, the Tesla patent teaches an approximate path which is nearly straight in the easy or forward direction of flow through the apparatus. FIG. 7 of the drawings associated with this specification show a modified drawing of FIG. 1 of the Tesla patent, modified by the addition of a straight line drawn through the central channels showing that core flow can follow an exact straight line in the easy or forward direction according to the teachings of the Tesla patent.

The apparatus of this invention operates directly contrary to the teachings of the Tesla patent. As the trunk channels of this invention are straightened, the overall head loss performance significantly decreases as a function of the straightening of the trunk channels. According to this invention, experiments have shown that the best overall head loss performance occurs when fluid flow is directed through trunk channels which deflect the flow at 45° angles with respect to each other. At page 2, lines 40–47, the Tesla patent teaches the flow in the hard or reverse direction experiencing only two small deviations from about 10° to 20°. At page 2, lines 57–62, the Tesla patent specifically teaches that in order to keep the head loss ratio as large as possible, sharp bends should be avoided, for these will add to both resistances and reduce the efficiency, and further teaches that whenever practicable, a piece should be straight.

FIGS. 8 and 9 of the drawings associated with this specification show a single-stage and a two-stage fluidic rectifier 20 wherein the trunk deflects at an angle of 15° with respect to a rectilinear axis parallel to rectilinear flow entering the body, and thus deflects at an angle of 30° with respect to adjacent channels. In an experiment conducted with such two-stage fluidic rectifier 20 of this invention, with the 30° deflection from one trunk channel to the next, the overall head loss ratio was 1.97. With the single-stage fluidic rectifier 20 having the 30° deflection from one trunk channel to the next, the overall head loss ratio was 1.42. As will be shown later in this specification, with the 45° deflection, the two-stage fluidic rectifier 20 of this invention produced an overall head loss ratio of 7.3, and the single-stage fluidic rectifier 20 having the 45° deflection produced an overall head loss ratio of 4.7–4.8, both of which are significantly improved when compared to the 30° deflection.

The Tesla patent suggests straightening the core channel, which may be viewed as the equivalent of the trunk channel of this invention, in order to increase the overall head loss ratio of the fluidic rectifier. Directly contrary to the teachings of the Tesla patent, experiments have shown that increasing such angle of deflection to approximately 45° optimizes the overall head loss ratio of this invention. It is important to note that this invention includes other differences in channel design and guide vane placement, as well as specific ventilation, specific entry elements or designs, and specific discharge configurations, with respect to flow in the hard or reverse direction, to achieve such drastically different and better overall head loss ratios.

The Tesla patent teaches relatively long and thin guide vanes. Such long and thin guide vanes tend to shave off or divert a portion of the core flow and route it into the reversing channel. As the flow passes through the reversing channel taught by the Tesla patent, the flow will lose appreciable energy and will simply discharge into and combine with the dominating, high-speed core flow. The flow discharged from the reversing channel taught by the Tesla patent will not span the core flow and will not enter the next reversing channel, as the dashed arrows of FIG. 1 of the Tesla patent show, since there will be extremely large energy differences between the core flow and the flow through the reversing channel.

At page 2, lines 6–10, the Tesla patent teaches that the partitions or guide vanes serve to direct the stream upon the reversing channels and to intensify the actions causing violent surges and eddies which interfere very materially with the flow through the conduit. According to the invention described in this specification and in the claims, eddies and other energy sinks are avoided since the apparatus of this invention uses the available energy to contract the flow area and obtain a head loss.

The Tesla patent teaches pipe nipples for the entries on both ends of the device. Quite contrary to such teachings of the Tesla patent, the invention defined by this specification and claims requires a sharp edge orifice for creating a vena contracta upon entry of the fluid into the trunk channel of the body. Forming such first vena contracta is a crucial aspect of this invention and significantly enhances the overall head loss ratio, as compared to the apparatus taught by the Tesla patent.

In view of the teachings of the Tesla patent and many comments regarding such apparatus by well-known authorities in fluid mechanics, it is apparent that there is a need for a fast-acting, responsive fluidic rectifier which has no moving parts and can be mass produced at reduced costs, particularly for use with a pulse combustor.

SUMMARY OF THE INVENTION

It is one object of this invention to provide a single-stage fluidic rectifier having a body which defines a trunk channel and a reversing channel, such that flow through the reversing channel impinges upon and contracts flow through the trunk channel to form a vena contracta.

It is another object of this invention to provide a multi-stage fluidic rectifier wherein multiple vena contractas are formed, each within a trunk channel of a corresponding stage of the multiple-stage fluidic rectifier.

It is another object of this invention to provide a fluidic entry into the body such that a vena contracta is formed upon fluid entering the body, with the fluid flowing in a reverse direction.

It is still another object of this invention to position each trunk channel and each reversing channel such that flow in a forward direction disables all vena contractas formed in the reverse direction, and such that the overall head loss in the forward direction is less than the overall head loss in the reverse direction.

It is yet another object of this invention to provide either a single-stage or a multiple-stage fluidic rectifier in which the final vena contracta formed, when fluid is flowing in the reverse direction, is enlarged to further restrict flow through the final trunk channel.

It is yet another object of this invention to provide either a single-stage fluidic rectifier or a multiple-stage fluidic rectifier that has a rounded and enlarged discharge positioned at a discharge area of the final trunk channel.

The above and other objects of this invention are accomplished with a single-stage fluidic rectifier having a body defining a trunk channel and a reversing channel that divides from the trunk channel and then rejoins the trunk channel at a downstream position, downstream with respect to flow in the reverse direction, of the trunk channel. As used throughout this specification and in the claims, the term "downstream" is a relative term and must be interpreted in view of the direction of fluid flow through the fluidic rectifier.

The inlet or entry for admitting fluid into the trunk channel and reversing channel of the body preferably has a sharp edge rectangular aperture positioned in a plane of an external face of the body, whereby in the reverse direction, the fluid enters the body in a direction approximately normal or perpendicular to the sharp edge rectangular aperture, thereby forming a first vena contracta within the trunk channel. The first vena contracta is formed only when the fluid is flowing in the reverse or hard direction.

At each stage of the fluidic rectifier, when fluid is flowing in the reverse direction, another vena contracta is formed within the corresponding trunk channel. Each such vena contracta is formed by fluid being discharged from the reversing channel and impinging upon and contracting trunk flow of the fluid through each respective trunk channel. Each such vena contracta is preferably formed by a particular positioning and shape of the reversing channel, the trunk channel and a guide vane. Such particular positioning and shape is extremely crucial to the overall efficiency of the fluidic rectifier according to this invention. The trunk channel and the reversing channel of each stage is also positioned and shaped so that each vena contracta is disabled when the fluid flows in the forward or easy direction through the fluidic rectifier.

The shape and positioning of the guide vane, which can either be an integral part of the body or a separate element secured within the body, is extremely critical to achieving an effective overall head loss efficiency of the fluidic rectifier. Also, the respective positioning of each trunk channel and each reversing channel, with respect to adjacent stages and also with respect to a direction of rectilinear flow entering the fluidic rectifier in the reverse direction, is also extremely critical to the overall efficiency of the fluidic rectifier according to this invention.

According to one preferred embodiment of this invention, in order to achieve an increased vena contracta in the trunk channel of the final stage of the fluidic rectifier, a vent, preferably formed within the body, is in communication between ambient and the trunk channel. The vent is preferably positioned within the trunk channel of the final stage, slightly downstream of an intersection between an outer side wall of the reversing channel and a side wall of the trunk channel. The vent is preferably positioned near the final vena contracta and thus effectively relieves a vacuum region created near such final vena contracta. By relieving the vacuum pressure in such region, the fluid flowing through the final trunk channel is further impinged upon by the reversing flow through the final reversing channel and is also thus further contracted to prevent or resist flow through such final trunk channel.

BRIEF DESCRIPTION OF THE DRAWINGS

The above and other objects of this invention, and the apparatus and method for accomplishing such objects of this invention will become more apparent when the specification is viewed in conjunction with the drawings, wherein.

BRIEF DESCRIPTION OF PREFERRED EMBODIMENTS

Figure 1:
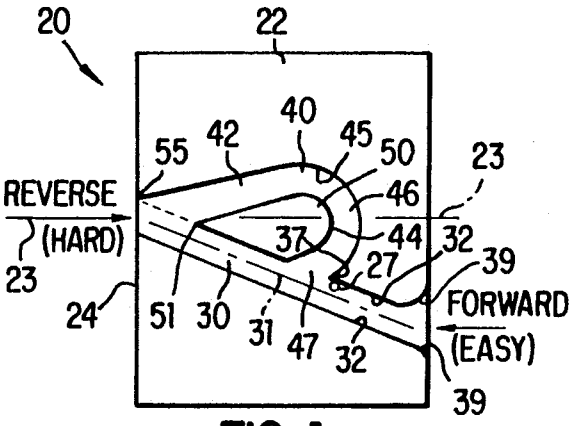
FIG. 1 is a front cross-sectional view of a single-stage fluidic rectifier, according to one preferred embodiment of this invention.
Figure 2:
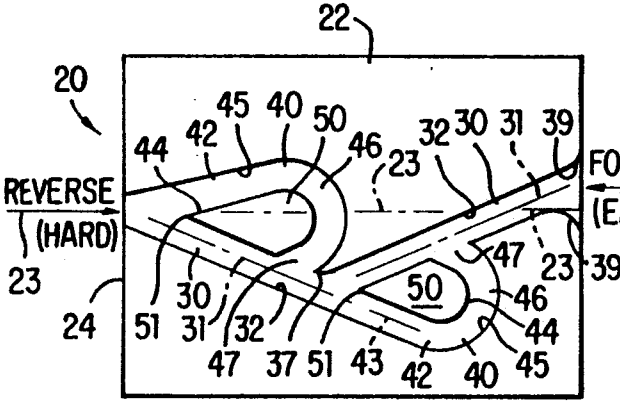
FIG. 2 is a front cross-sectional view of a two-stage fluidic rectifier, according to another preferred embodiment of this invention.
Figure 3:
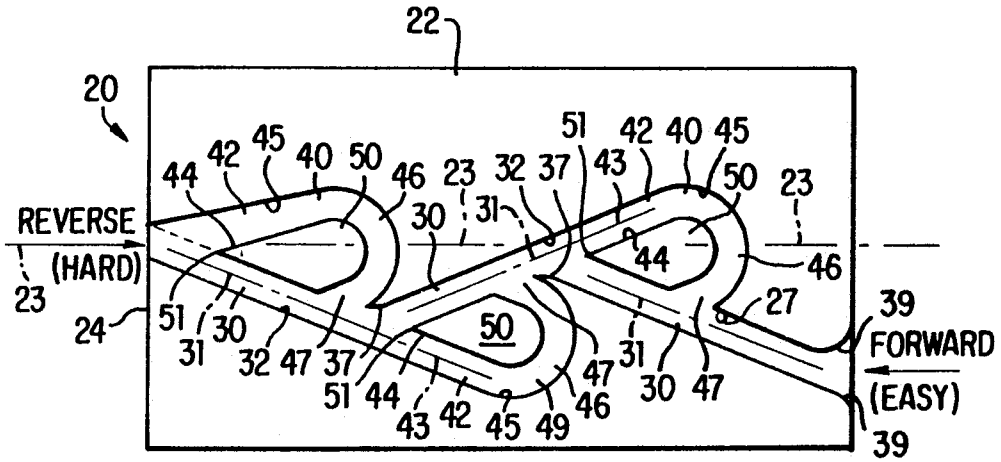
FIG. 3 is a front cross-sectional view of a three-stage fluidic rectifier, according to another preferred embodiment of this invention.
Figure 4:
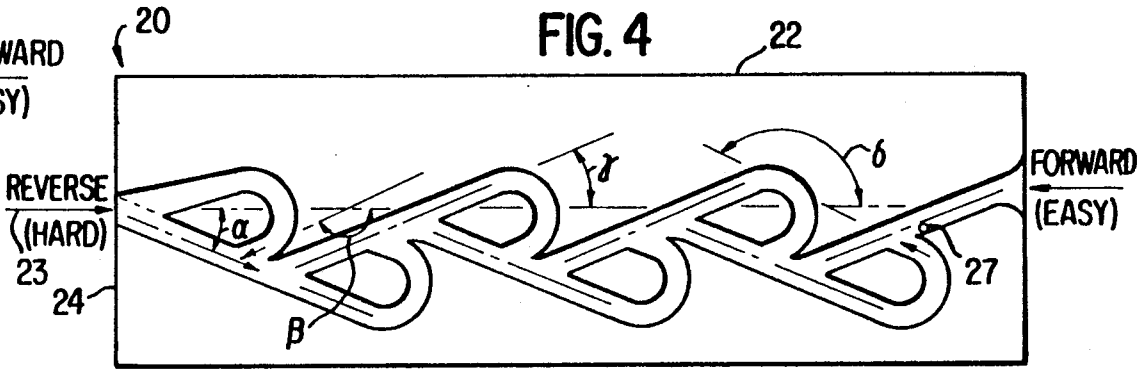
FIG. 4 is a front cross-sectional view of a six-stage fluidic rectifier, according to another preferred embodiment of this invention.
Figure 10:
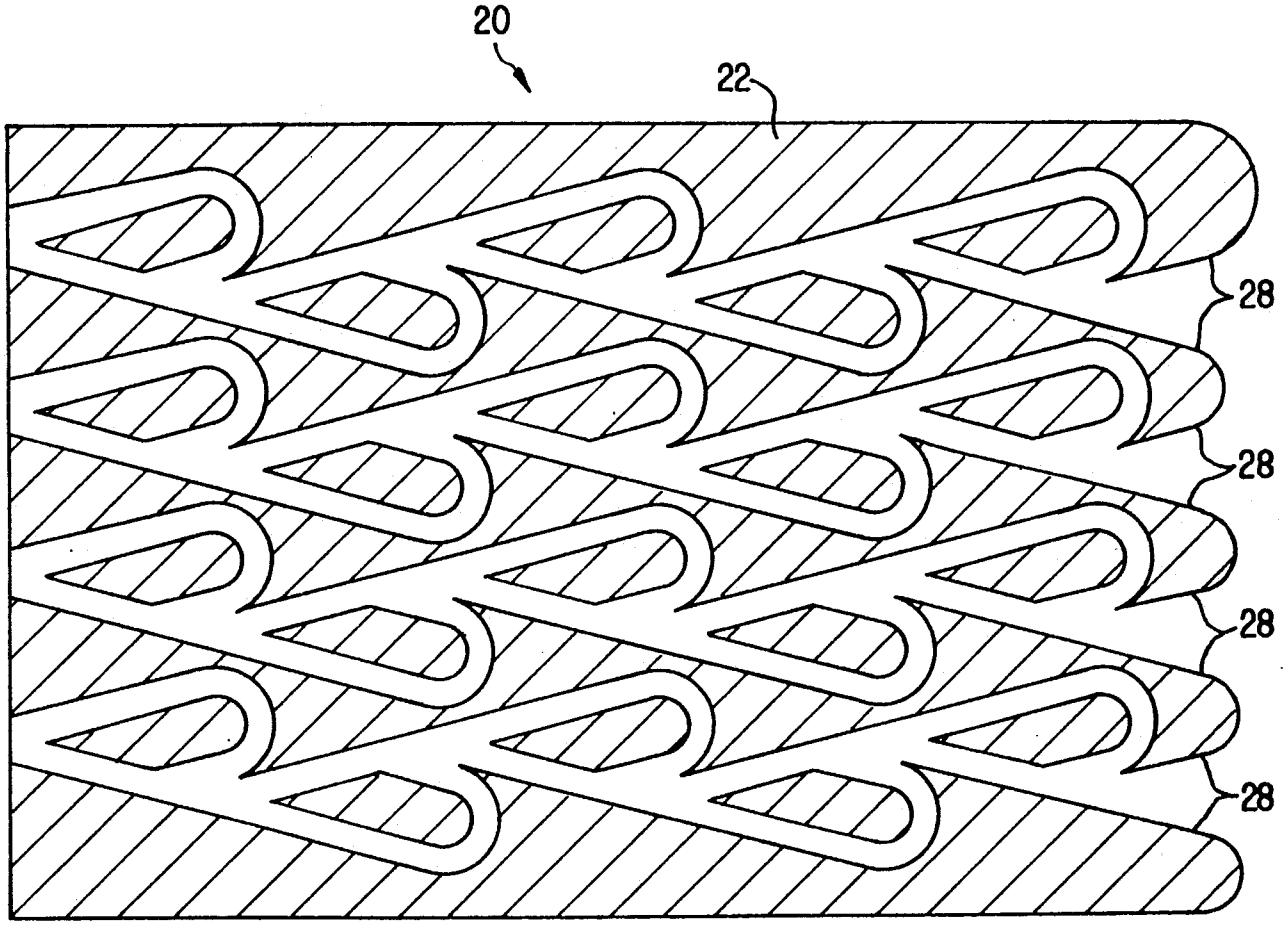
FIG. 10 is a front cross-sectional view of an early design of four parallel multiple-stage fluidic rectifiers, which was tested according to this invention.

FIG. 1 shows a single-stage fluidic rectifier 20, according to one preferred embodiment of this invention. FIGS. 2–4 show multi-stage fluidic rectifiers 20, according to other preferred embodiments of this invention. FIGS. 1A, 2A, 3A and 4A show preferred fluidic rectifiers 20, which respectively correspond to FIGS. 1–4 but have specific dimensions and precise layouts which have been tested and proven effective. FIGS. 1–4A show cross-sectional views of preferred embodiments of fluidic rectifier 20, but the crosshatching is not shown for purposes of clarity; equivalent crosshatching is shown in FIG. 10. Although not shown in FIGS. 1–4A, or in other drawings associated with this specification, a side view of fluidic rectifier 20, according to this invention would show that trunk channel 30, reversing channel 40 and associated elements can be relatively wide, or deep into the paper as shown in the drawings.

Referring to FIG. 1, trunk channel 30 and reversing channel 40 are preferably molded within body 22. According to one preferred embodiment of this invention, trunk channel 30 and reversing channel 40 are stamped with a die tool in a block of material, such as a suitable metal or other sufficiently hard and durable material. Trunk channel 30 and reversing channel 40 preferably form guide vane 50 with leading edge 51. It is apparent that guide vane 50 can be an integral part of body 22, or can be a separate element secured to or with respect to body 22. It is apparent that by forming trunk channel 30 and reversing channel 40 with a die tool, manufacturing costs can be significantly reduced by stamping fluidic rectifiers 20 in mass quantities.

Throughout this specification and in the claims, the terms "downstream", "reverse or hard direction" and "forward or easy direction" are all relative to the particular mode of operation of the fluidic rectifier 20. As shown in FIG. 1, the forward direction and reverse direction are indicated by the corresponding arrows. Fluid flow in a forward direction experiences an overall pressure drop across fluidic rectifier 20 which is less than the overall pressure drop across fluidic rectifier 20 with fluid flowing in the reverse direction, as will be discussed throughout the specification and in the claims.

Also, as used throughout this specification and in the claims, values for angles and specific dimensions are sometimes stated in relatively specific and relatively exact numbers. However, throughout this specification and in the claims, such numbers are intended to be approximate relative to the sensitivity of such angles and dimensions to the overall head loss ratio of fluidic rectifier 20. The specific angles and dimensions identified have been proven to provide the most efficient overall head loss ratio for one preferred embodiment of fluidic rectifier 20 according to this invention. By using the term "approximately" or "about" when describing such angles and dimensions, it is intended to mean that such values of the angles and dimensions can be varied until the overall head loss ratios of fluidic rectifier 20 drop significantly, for example as low as head loss ratios associated with conventional fluid diodes having no moving parts and an equivalent number of stages. In order to achieve the overall head loss ratios identified later in this specification, certain parameters and elements are extremely necessary in order to achieve such head loss ratios. For example, it is extremely important for the fluid to enter a sharp edge orifice or for body 22 to form an equivalent sharp edge orifice. It is extremely important for straight section 42 of reversing channel 40 to converge, particularly at the angles shown in FIGS. 1A, 2A, 3A and 4A. It is extremely important for trunk channels 30 and reversing channels 40 to have their relative position in the first stage and in subsequent stages. It is extremely important for guide vanes 50 to form sharp leading edge 51. Varying certain dimensions or angles may vary the overall head loss ratios more than other angles or dimensions.

According to one preferred embodiment of this invention, fluidic rectifier 20 comprises first means for forming a first vena contracta upon entry of the fluid into trunk channel 30 of body 22, when the fluid is flowing in the reverse direction. According to one preferred embodiment of this invention, the first means for forming the first vena contracta comprise body 22 forming sharp edge rectangular aperture 55 which is preferably positioned in a plane of external face 24 of body 22. In the reverse direction, fluid enters body 22 approximately normal or perpendicular to sharp edge rectangular aperture 55, in order to form first vena contracta 25 within body 22 at the entry of trunk channel 30, where reversing channel 40 first divides from trunk channel 30. It is apparent that a sharp edge orifice plate can also be positioned with respect to or attached to body 22, in lieu of body 22 forming sharp edge rectangular aperture 55, in order to achieve the same result of forming first vena contracta 25 within the first stage, as shown in FIG. 5.

Figure 5:
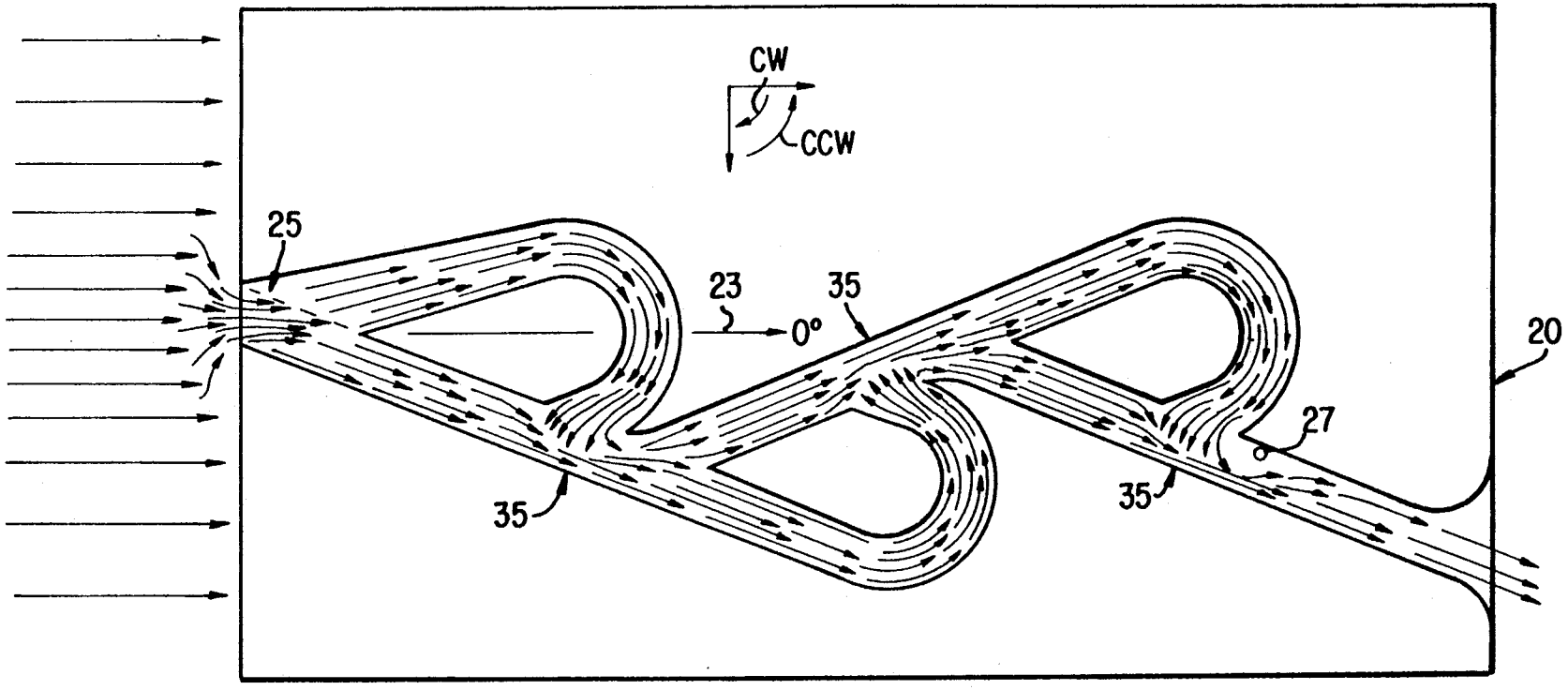
FIG. 5 is a schematic diagram showing fluidic flow patterns through a fluidic rectifier according to this invention.
Figure 6:
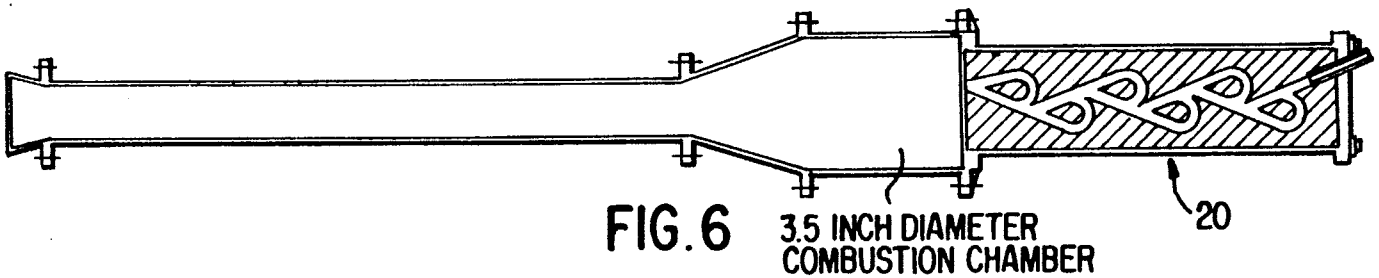
FIG. 6 is a schematic diagram showing a fluidic rectifier mounted to a pulse combustor, according to another preferred embodiment of this invention.
Figure 8:
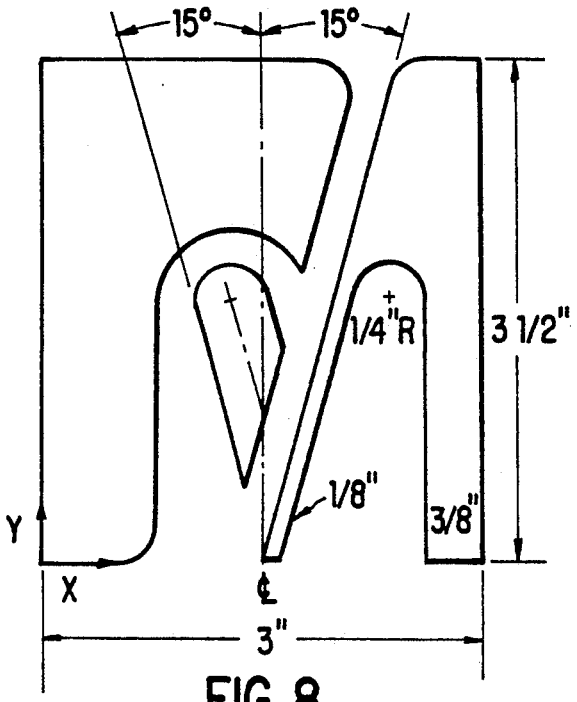
FIG. 8 is a front cross-sectional view of a single-stage element having a relatively small angle of deflection between the trunk channel and a direction of rectilinear flow entering the fluidic rectifier.
Figure 9:
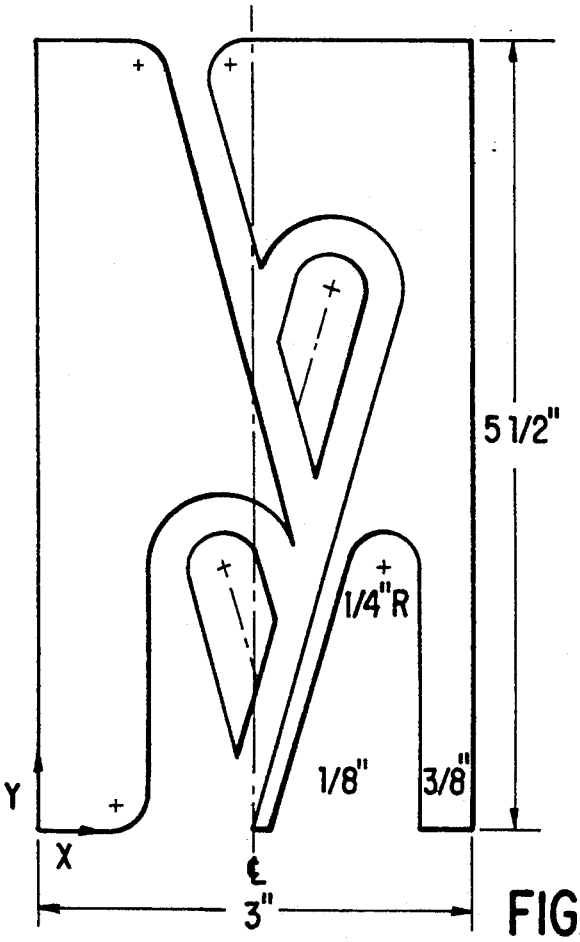
FIG. 9 is a front cross-sectional view of a two-stage fluidic rectifier having a relatively small angle of deflection between both trunk channels within the body.

Fluidic rectifier 20 also comprises second means for forming second vena contracta 35 within trunk channel 30, whereby reversing flow of the fluid, which is discharged from reversing channel 40, impinges upon and contracts trunk flow of the fluid through trunk channel 30, as shown in FIG. 5. Such second vena contracta 35 is formed, according to one preferred embodiment of this invention, with a particular design wherein trunk channel 30 defines trunk axis 31. Trunk axis 31 is positioned at a first acute angle $\alpha$ of approximately 22.5°, measured clockwise (cw) from 0° rectilinear axis 23, as shown in FIG. 4. As shown in FIG. 5, 0° rectilinear axis 23 is parallel to a direction of rectilinear flow entering fluidic rectifier 20, in the reverse direction. As used in this specification and throughout the claims, rectilinear axis 23 is arbitrarily defined as having a 0° angle, which is shown in FIG. 5 as horizontal flow. It is apparent that the specific selection of 0° for rectilinear axis 23 is chosen as a point of reference and that all other angles discussed throughout this specification and in the claims are relative to such selected angle. FIG. 5 also shows the clockwise (cw) and counterclockwise (ccw) convention set up for reference to other angles discussed throughout this specification and in the claims. It is apparent that rectilinear axis 23 can have any other set angle and it is also apparent that the other corresponding angles would have the same relative positioning, but may have other values, depending upon the chosen position of rectilinear axis 23.

Reversing channel 40 comprises straight section 42, which defines straight section axis 43, and curved section 46. As shown in FIG. 1 and in the first stages of fluidic rectifier 20 of FIGS. 2–4, straight section 42 has a cross-sectional area converging in the downstream direction, relative to flow in the reverse direction. As shown in FIGS. 1A, 2A, 3A and 4A, inner side wall 44 is positioned at an angle of approximately 163.77°, measured cw from 0° rectilinear axis 23, and outer side wall 45 is positioned at an angle of approximately 167.57°, measured cw from 0° rectilinear axis 23. Thus, according to one preferred embodiment of this invention, straight section 42, which preferably has a rectangular cross-section, converges at an included angle of approximately 3.8° between inner side wall 44 and outer side wall 45.

Discharge portion 47 of curved section 46 of reversing channel 40 intersects trunk channel 30 such that reversing flow discharged from reversing channel 40 impinges trunk flow within trunk channel 30 at angle $\beta$ of approximately 157.5°, measured cw from 0° rectilinear axis 23.

Figure 1A:
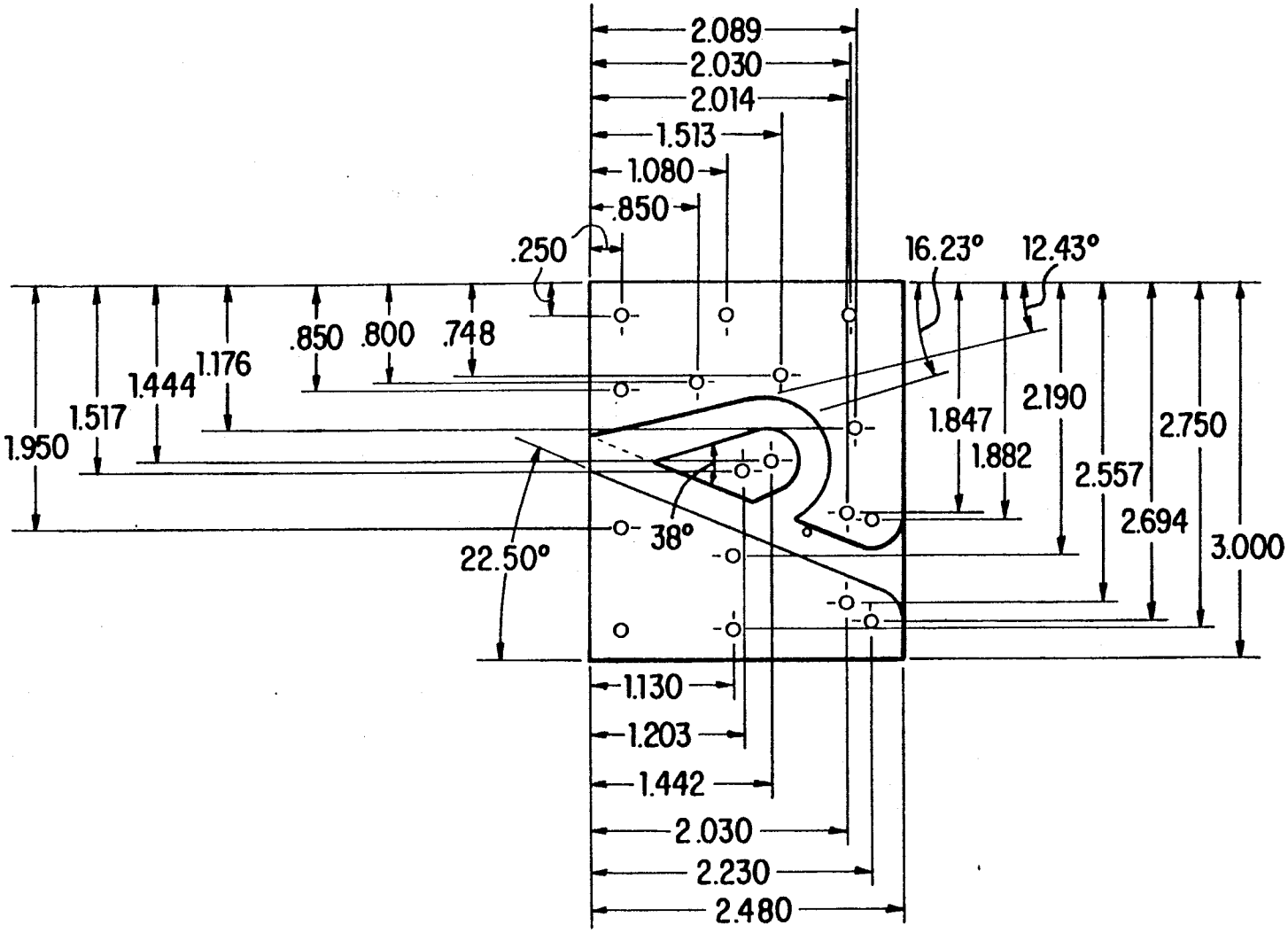
FIG. 1A is a front cross-sectional view of the fluidic rectifier shown in FIG. 1, having precise dimensions.

Whether formed as an integral part of body 22 or as a separate element, guide vane 50 is positioned between trunk channel 30 and reversing channel 40. Guide vane 50 has sharp leading edge 51 which is presented into the fluid flowing in the reverse direction. According to one preferred embodiment of this invention, sharp leading edge 51 of guide vane 50 preferably forms an included angle of approximately 38.0°. After experimentation with the positioning, size and shape of guide vane 50, it was determined that the specific dimensions shown in FIGS. 1A, 2A, 3A and 4A are extremely crucial to achieving maximum head loss performance of each corresponding preferred embodiment of fluidic rectifier 20. For example, as shown in FIG. 1A, the 1.444 inch distance of sharp leading edge 51 of guide vane 50 from the top side of the element, particularly with respect to the 1.517 inch dimension of one side of sharp edged rectangular aperture 55, was found to be extremely sensitive. In other words, moving guide vane 50 from the precise position shown in FIG. 1A drastically varied the overall head loss efficiency and performance of fluidic rectifier 20 shown in FIG. 1. Also, the length of guide vane 50 in the horizontal direction as shown in the drawings, from sharp leading edge 51, as well as the curvature of inner side wall 44 and outer side wall 45 of reversing channel 40 was found to be very critical for achieving maximum efficiency of fluidic rectifier 20.

Guide vane 50 is preferably positioned between trunk channel 30 and reversing channel 40, such that sharp leading edge 51 divides the fluid, when flowing in the reverse direction, into trunk flow through trunk channel 30 in a trunk mass flow amount and reversing flow through reversing channel 40 in a reversing mass flow amount, so that trunk flow nomentura of the trunk flow and reversing flow momentum of the reversing flow create maximum contraction of the trunk flow at an area of impingement of the reversing flow against the trunk flow, as shown in FIG. 5.

In one preferred embodiment according to this invention, curved section 46 of reversing channel 40 is approximately as wide as trunk channel 30, as shown in FIG. 1 and the first stages of FIGS. 2–4. Downstream from the initial stage of a multiple-stage fluidic rectifier 20, in the reverse direction, trunk channel 30 is approximately as wide as both straight section 42 and curved section 46 of reversing channel 40. Again, it is extremely important for only the first stage to comprise straight section 42 with a converging cross-sectional area. It is equally important for the downstream straight sections 42, with respect to flow in the reverse direction, to not have a converging cross-sectional area.

According to one preferred embodiment of this invention, curved section 46 has a constant mean radius of curvature of approximately 1.5 times the width of trunk channel 30. Trunk channel 30 and reversing channel 40 each preferably have a rectangular cross-section, which is shown in FIGS. 1–4.

As shown in FIGS. 1, 3 and 4, vent 27 is positioned within body 22. Vent 27 preferably communicates between ambient and trunk channel 30, downstream when fluid is flowing in the reverse direction of an intersection between outer side wall 45 of reversing channel 40 and side wall 3.2 of trunk channel 30. Vent 27 is preferably positioned near second vena contracta 35 as shown between FIGS. 1 and 5, and near the final second vena contracta 35 as shown between FIGS. 2–4 and 5. During operation of fluidic rectifier 20 with fluid flowing in the reverse direction, vent 27 relieves a vacuum pressure region and such relief tends to further contract flow through trunk channel 30 at such region. When fluidic rectifier 20 is used in a pulse combustor, converging inlet sections 28, as shown in FIG. 10, can be used in lieu of vent 27 to accomplish the same result of relieving the vacuum pressure. Fluidic rectifier 20 of FIG. 10 is shown only for the purpose of illustrating how a plurality of multiple-stage fluidic rectifiers 20 can be incorporated into a parallel arrangement within body 22, and to show converging inlet section 28. The particular multiple-stage fluidic rectifier 20 shown in FIG. 10 was tested and the overall head loss ratio proved to be very poor, relative to the specific arrangement of fluidic rectifier 20 shown in FIGS. 4 and 4A, for example.

According to one preferred embodiment of this invention, fluidic rectifier 20 further comprises disablement means for disabling first vena contracta 25 and all subsequent second vena contractas 35, which includes further downstream vena contractas 35 in a multiple-stage fluidic rectifier, when the fluid flows in a forward direction through fluidic rectifier 20. According to one preferred embodiment of this invention, the disablement means comprise trunk channel 30 having a rectangular cross-section and opposing side walls 32 of trunk channel 30 forming rounded outlet 39, outlet with respect to the downstream direction when fluid is flowing in the reverse direction. Rounded outlet 39 is in a downstream area where trunk channel 30 forms a discharge or exit of body 22, in the downstream direction when fluid is flowing in the reverse direction. Such rounded outlet 39, as shown in FIGS. 1–4, prevents vena contractas from forming within trunk channel 30. The disablement means may also comprise the continuous side wall 32 of trunk channel 30, as shown in FIG. 4, having a curved corner 37. Experimentation has proven that curved corner 37 is extremely critical in maximizing the overall head loss ratio of fluidic rectifier 20, since curved corner 37 tends to eliminate any areas of impingements.

Fluidic rectifier 20 has no moving parts and thus is an appropriate type of check valve to use with pulse combustors. Fluidic rectifier 20 can be used with pulse combustors that operate at a relatively high frequency, whereas conventional flapper check valves and other check valves having moving parts cannot effectively operate a such high frequencies. Thus, relatively large, high-pressure rise, pulsating combustors can be used without encountering scaling problems associated with enlarged valves that comprise moving parts. Delicate flaps of conventional flapper check valves are exposed to damaging vibratory fatigue, impact and high temperature in a high-pressure pulse combustor.

A check valve, aerovalve or fluidic rectifier suitable for pulse combustors must be compact and fast-acting so that the pulse combustor will not be deprived of pre-ignition compression energy or of post-ignition combustion energy. Lowering such energies decreases the thermal efficiency of the pulse combustor. Also, attaching relatively large aerovalve volumes to the pulse combustor can destabilize the critical resonating combustion process, excite unwanted oscillatory modes, or dampen the combustion oscillation, all of which cause performance reductions.

Referring to FIG. 1A, the single-stage fluidic rectifier 20 of such preferred embodiment was tested. The results at different operating conditions are shown below in Table 1. The single-stage fluidic rectifier 20 according to this invention produced a head loss ratio of nearly five (5). The performance of fluidic rectifier 20, according to this invention, is quite sensitive to the precise dimensions shown in FIGS. 1A, 2A, 3A and 4A. In order to obtain the performance shown in Table 1, for example, fluidic rectifier 20 must be reproduced according to the precise dimensions shown in FIG. 1A. If working fluids, velocity or hydraulic radius are varied, the rules of dynamic similitude must be obeyed to preserve the Reynolds Number and thus obtain identical performance of fluidic rectifier 20.

TABLE 1

| GPM | PSIG HARD | PSIG EASY | HEAD LOSS RATIO |
|---|---|---|---|
| 5 | 33 | 7 | 4.7 (with vent) |
| 4 | 21 | 4.5 | 4.66 (with vent) |
| 3 | 12 | 2.5 | 4.8 (with vent) |

As shown in FIG. 1A, sharp leading edge 51 is positioned on a line 1.444 inches from the top side surface of body 22. Such dimension is so critical that, for example, by increasing such dimension by 0.073 inches to position sharp leading edge 51 on a line 1.517 inches from the same top side surface, dropped the overall performance or efficiency of fluidic rectifier 20 by twenty-eight percent (28%).

Figure 2A:
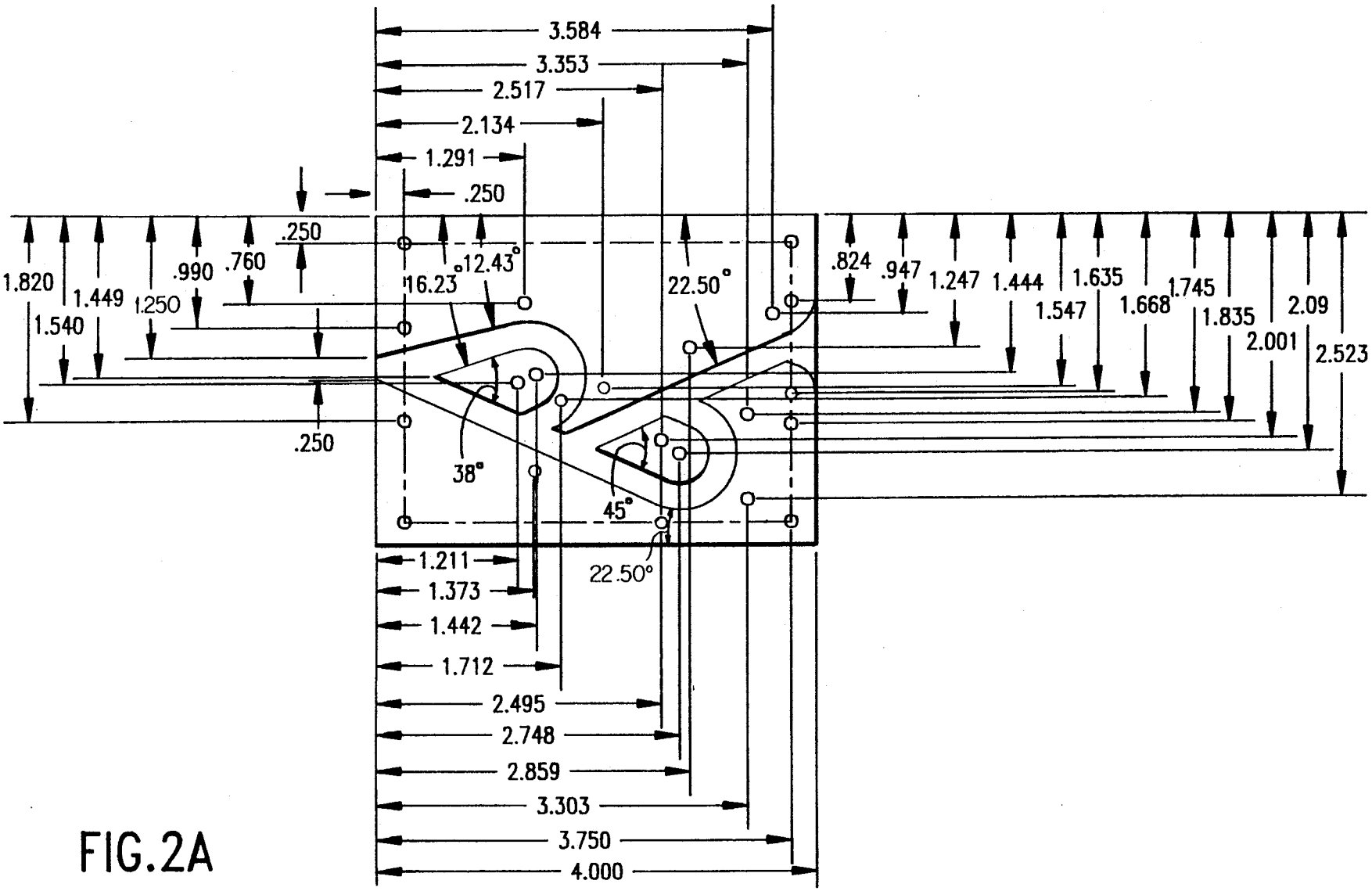
FIG. 2A is a front cross-sectional view of the fluidic rectifier shown in FIG. 2, having precise dimensions.

As shown in FIG. 2A, a two-stage element was tested, without vent 27 as shown in FIGS. 2 and 2A, and provided the results under the conditions shown in Table 2.

TABLE 2

| GPM | PSIG HARD | PSIG EASY | HEAD LOSS RATIO |
|---|---|---|---|
| 5 | 66 | 9 | 7.3 (no vent) |
| 4 | 42 | 6 | 7 (no vent) |
| 3 | 24 | 3.5 | 6.8 (no vent) |

TABLE 2-continued

| GPM | PSIG HARD | PSIG EASY | HEAD LOSS RATIO |
|---|---|---|---|
| 2 | 12 | 2 (−) | 6 (+) (no vent) |

According to fluidic rectifier 20 as shown in FIG. 2A, the head loss ratio increased, with respect to the single-stage fluidic rectifier 20 shown in FIG. 1A, to a head loss ratio of nearly seven (7).

Figure 3A:
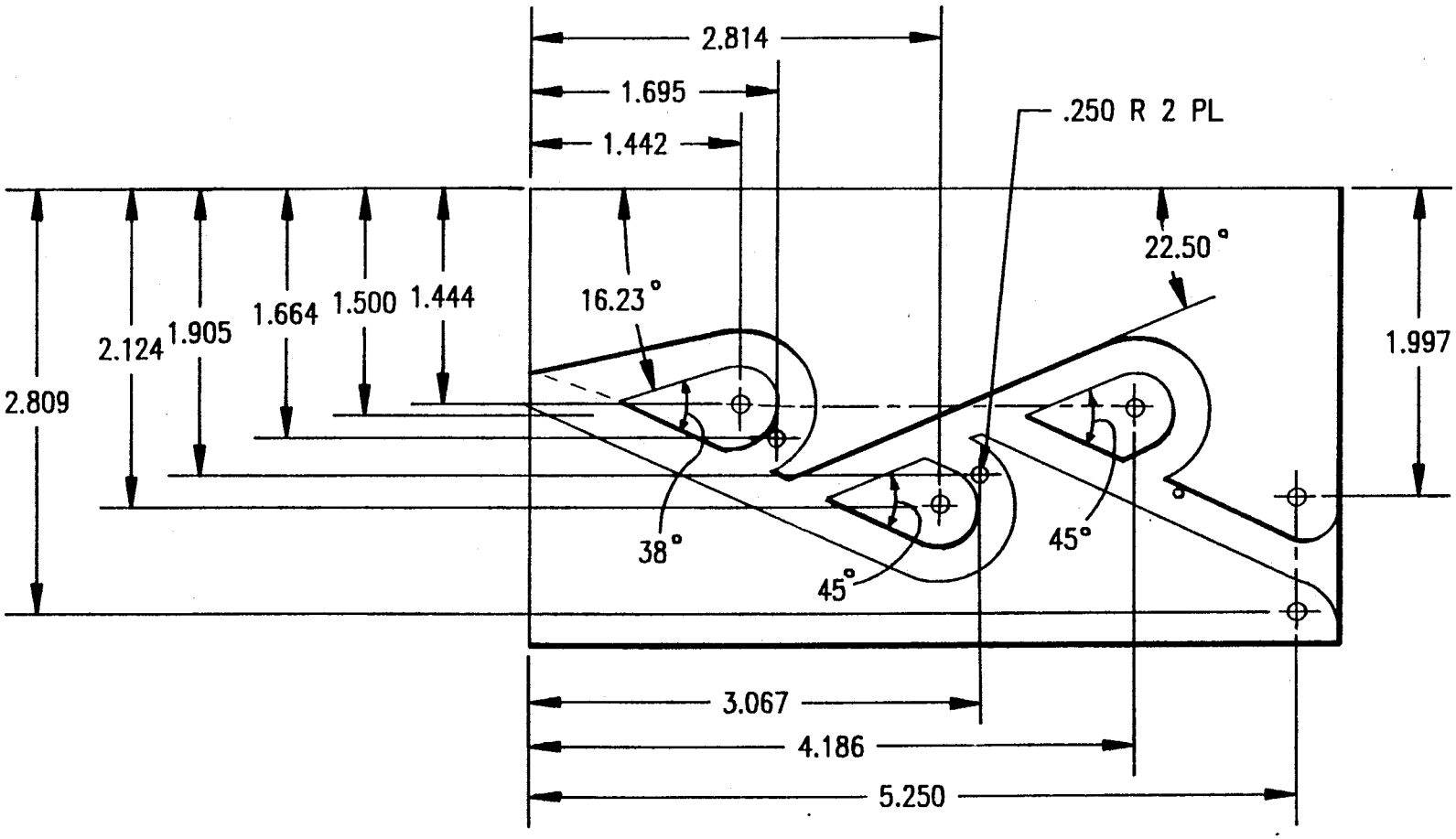
FIG. 3A is a front cross-sectional view of the fluidic rectifier shown in FIG. 3, having precise dimensions.

FIG. 3A shows precise dimensions and positioning of the elements of a three-stage fluidic rectifier 20, according to one preferred embodiment of this invention. Such three-stage fluidic rectifier 20 was tested and produced and the results under the conditions shown in Table 3.

TABLE 3

| GPM | PSIG HARD | PSIG EASY | HEAD LOSS RATIO |
|---|---|---|---|
| 4.7 | 94 | 9.8 | 9.6 (with vent) |
| 4 | 68 | 7 | 9.7 (with vent) |
| 3 | 40 | 4 | 10 (with vent) |

By increasing the number of stages to three, the overall head loss ratio of fluidic rectifier 20 was increased to nearly ten (10).

Figure 4A:
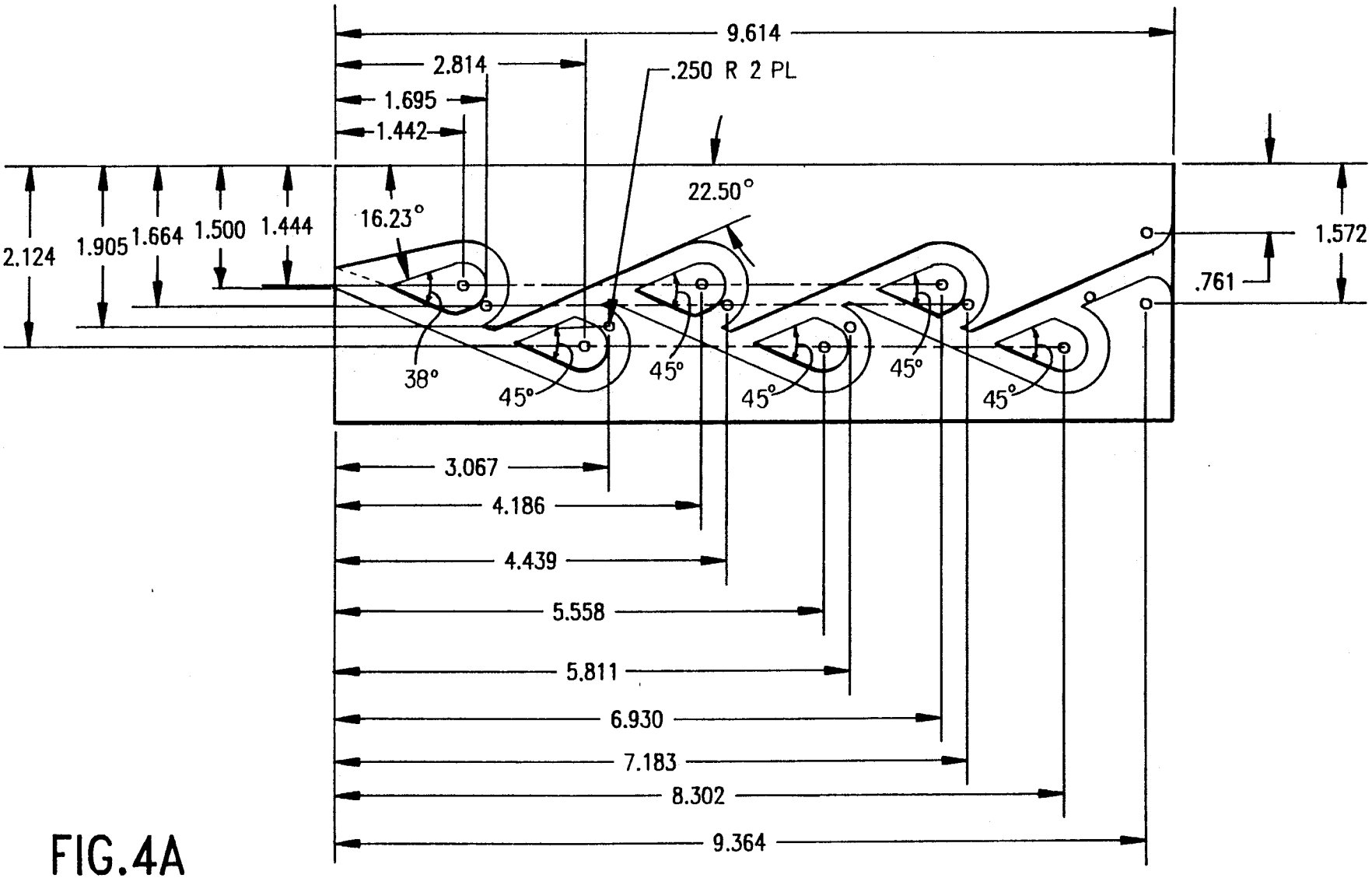
FIG. 4A is a front cross-sectional view of the fluidic rectifier shown in FIG. 4, having precise dimensions.

FIG. 4A shows the precise dimensions and positioning of elements associated with a six-element fluidic rectifier 20, according to another preferred embodiment of this invention. Tests were conducted with a six-stage element as shown in FIG. 4A and Table 4 represents the results under the specific conditions for such preferred embodiment of this invention.

TABLE 4

| GPM | PSIG HARD | PSIG EASY | HEAD LOSS RATIO |
|---|---|---|---|
| 3.3 | 100 | 8 | 12.5 (with vent) |
| 3 | 83 | 7 | 11.85 (with vent) |
| 2 | 36 | 3 | 12 (with vent) |
| 1 | 9 | 1 (−) | 9 (with vent) |

The six-stage fluidic rectifier 20, according to this invention, produced an overall head loss ratio of approximately twelve (12).

It is apparent from the limited experiments conducted with the elements as shown in FIGS. 1A, 2A, 3A and 4A, that by increasing the number of stages of fluidic rectifier 20, the overall head loss ratio can also be increased. The experiments were conducted and the results obtained with water as the fluid.

Fluidic rectifier 20, according to this invention, operates by forming a series of vena contractas having head losses which accumulate in a non-linear fashion. Such jet contractions occur in the reverse or hard direction of flow, while such jet contractions do not occur in the forward or easy direction of flow.

Results obtained from this invention are unexpected, since many well known prior art references in the art of fluid mechanics teach away from the idea of adding flow elements in series to form fluid diodes. Fluidic rectifier 20 according to this invention has a number (n) of identical flow elements in series, wherein each element possesses a reverse or hard direction head loss ($h_d$) and a forward or easy direction head loss ($e_d$). The overall head loss ratio for fluidic rectifier 20 of this invention is (hd/ed), which can be written as:

$$\frac{(hd_1 + hd_2 + hd_3 + \ldots + hd_n)}{(ed_1 + ed_2 + ed_3 + \ldots + ed_n)} \leqq \frac{hd}{ed}.$$

Thus, the overall head loss ratio cannot be higher than the head loss ratio of a single-stage fluidic rectifie· 20, since as desirable head loss in the reverse or hard direction is added, by appending additional flow elements, undesirable head loss in the forward or easy direction is also automatically added in the same proportion. However, according to fluidic rectifier 20 of this invention, as stages are added, head losses grow faster with respect to head loss in the reverse or hard direction, as compared to head losses with respect to flow in the forward or easy direction. Fluidic rectifier 20 according to this invention thus produces unexpected results by performing against the teachings theoretically predicted with respect to head loss ratios of series flow elements.

According to this invention, fluidic rectifier 20 operates by producing pressure drops exclusively by special jet contractions or vena contractas, that allow the trunk flow through trunk channel 30 to maintain its initial velocity and thus maintain its specific momentum which effects a sizable contraction at a downstream jet impingement.

Considering a method of flow through a two-stage fluidic rectifier 20 according to one preferred embodiment of this invention, in the initial or early stages, fluid flow entering in the reverse or hard direction enters through sharp edge rectangular aperture 55. The exterior surface of the valve is preferably flat. Fluid entering at sharp edge rectangular aperture 55 produces a pressure drop by a large contraction of the flow area of the entering fluid jet, but maintains a high jet velocity. Known discharge data of various openings show the sharp edge orifice, such as in a flat face, to contract the flow area by thirty-six percent (36%). Such reduction in flow area produces a substantial head loss and thus a reduction of flow rate. It is important to note that the portion of fluid that passes through the contracted area maintains its velocity. Known discharge data shows that only about three percent (3%) of the original jet velocity is lost. The high velocity and thus large specific momentum is available for downstream impingements.

Referring to FIG. 5, after the flow is contracted and first vena contracta 25 is formed as the fluid enters the body through the sharp edge orifice, the contracted flow blooms and then encounters sharp leading edge 51 of guide vane 50 of the first stage. Sharp leading edge 51 of guide vane 50 divides the incoming fluid into flow through first trunk channel 30 and first reversing channel 40. As shown in FIG. 1A, 2A, 3A and 4A, sharp leading edge 51 of the first stage is formed by guide vane 50 having an included angle of 38°. The portion of fluid flowing through first trunk channel 30 is directed at angle a of approximately 22.5° measured cw from 0° rectilinear axis 23. Guide vane 50 of the first stage preferably apportions the incoming flow such that the momentum of the reversing flow and the trunk flow causes a maximum contraction of the trunk flow at the first impingement area. Second vena contracta 35 which is formed at the first impingement area is quite sensitive to the apportionment of the momentum. During experimentation, visual inspection of tiny bubbles in the fluid flow shows that second vena contraction 35 is approximately 50%.

After second vena contraction 35 is formed, the first impinged fluid blooms in first trunk channel 30 and then encounters sharp leading edge 51 of guide vane 50 of the second stage, where the first impinged flow is apportioned into a first portion which flows through second trunk channel 30 at angle $\gamma$ of approximately 22.5°, measured ccw from 0° rectilinear axis 23, and a remaining portion of the first impinged fluid through second curved section 46 of second reversing channel 40, such that the remaining portion of the first impinged fluid impinges the first portion of the first impinged flowing through second trunk channel 30 at angle $\delta$ approximately 157.5° measured ccw from 0° rectilinear axis 23. For purposes of clarity, FIG. 4 shows the various angles discussed in this specification but does not show element numbers; equivalent element numbers are shown in FIG. 3.

Guide vane 50 of the second stage has an included angle of 45° which forms sharp leading edge 51 of the second stage. The division of the first impinged fluid within the second stage is apportioned so that the momentum of reversing flow and trunk flow through the second stage cause a maximum contraction of the first portion of the first impinged fluid flowing through second trunk channel 30, at a second impingement area.

The included angle of guide vane 50 which forms sharp leading edge 51 changes from 38° in the first stage to 45° in the second and subsequent stages. When the fluid enters body 22, the flow field changes throughout the first stage so that it is necessary to change the included angle of guide vane 50 of the second stage from 38° to 45°. Throughout the second and subsequent stages, the flow fields through each subsequent stage do not change and thus each subsequent stage has guide vane 50 with an included angle of 45° forming sharp leading edge 51. This is a very important aspect of this invention.

As shown in FIG. 5, as the fluidic jets of the reversing flow through reversing channel 40 impinge upon trunk flow through trunk channel 30, the trunk flow is "thinned out" and thus a strong contraction of the trunk flow is produced, without significantly decelerating the passing impinged fluid.

Through experimentation, it has been found that specific geometries of trunk channel 30, reversing channel 40 and guide vane 50 which decrease the velocity of the trunk flow that passes the first stage will produce relatively poor overall head loss performance of fluidic rectifier 20, according to the apparatus of this invention. Other known discharge data for various entries show that other types of orifice or configurations can cause contractions but also decrease the velocity of the impinged fluid.

Experimentation of fluidic rectifier 20 according to this invention has proven that the specific geometries shown in the drawings, particularly in FIGS. 1A, 2A, 3A and 4A, are extremely critical in maximizing overall performance and increasing the head loss ratio. For example, referring to FIGS. 1 and 1A, as previously discussed, by increasing the dimension from sharp leading edge 51 to the top side of body 22 by 0.073 inch, the overall head loss dropped twenty-eight percent (28%) in the reverse or hard direction of flow. As shown in FIG. 1A, the position of guide vane 50 nearly optimizes the momentum of the trunk flow and the reversing flow to produce a maximum contraction of the trunk flow at the impingement area.

It is important to note the asymmetry of guide vanes 50 in the multiple-stage fluidic rectifier 20, as best shown in FIGS. 4 and 4A. By varying the position of trunk axis 31, straight section axis 43 and curved section 46, relative to each other and relative to 0° rectilinear axis 23, the head loss ratio can be significantly reduced and thus can lower the overall performance of fluidic rectifier 20 according to this invention.

Each reversing channel 40 produces a local contraction in trunk channel 30 and guides or directs a portion of the impinged flow into the next downstream reversing channel 40. In order to obtain optimum performance, guide vane 50 preferably has two sharp edges, one being sharp leading edge 51, the other being further downstream, with respect to fluid flowing in the reverse direction, along trunk channel 30. By altering the shape of guide vane 50 to a teardrop or airfoil shape to obtain a more head-on collision of the intersecting flows, for example, in an effort to neutralize greater momentum, the head loss in the reverse or hard direction drops nearly 504 in the single-stage fluidic rectifier 20, as shown in FIGS. 1 and 1A.

Figure 7:
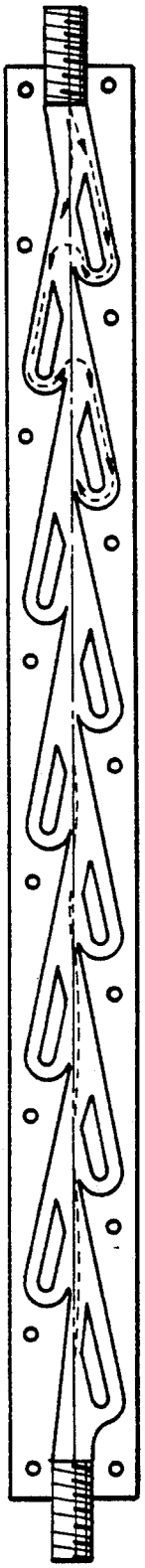
FIG. 7 (PRIOR ART)
FIG. 7 represents prior art which is an enlarged and modified copy of FIG. 1 from Tesla, U.S. Pat. No. 1,329,559.

Tesla, U.S. Pat. No. 1,329,559, specifically teaches a nearly straight channel for fluid to flow in the forward or easy direction, so that the fluid encounters very small resistance and passes through freely and undisturbed in the easy direction. FIG. 7 shows prior art, which is FIG. 1 of the Tesla patent, enlarged to show that flow in the forward or easy direction can follow a path along a straight line which is drawn through the center of the various channels. Directly contrary to the teachings of the Tesla patent, if trunk channels 30 in a multiple-stage fluidic rectifier 20 according to this invention are similarly straightened to reduce head loss in the forward or easy direction, the reverse or hard direction head loss will drop in proportion to the straightening and the overall performance will be reduced.

According to one preferred embodiment of this invention, the first or entry trunk channel 30 has trunk axis 31 which is at angle a of approximately 22.5° measured cw from 0° rectilinear axis 23. The next downstream trunk channel 30 has trunk axis 31 which is positioned at angle $\gamma$ of approximately 22.5° measured ccw from 01 rectilinear axis 23. In other words, the impinged fluid follows a path of approximately a 45° shift from first trunk channel 30 to the second trunk channel 30.

The Tesla patent suggests straightening series trunk channels 30 of this invention to achieve a better overall head loss ratio. Quite to the contrary, according to fluidic rectifier 20 of this invention, experimentation showed that, for example, straightening the 45° deflection or shift to 27° reduced the overall head loss ratio by about seventy percent (70%). Experimentation also showed that by increasing such 45° deflection or shift to greater than 45° also lowered the overall head loss ratio. According to one preferred embodiment of this invention, 45° is an optimum shift angle.

If guide vanes 50 are constructed narrower and/or longer than shown in FIGS. 1A, 2A, 3A and 4A, the overall performance of fluidic rectifier 20 drops in proportion to the amount of modification. As shown in FIG. 2, it is important to note that in a multiple-stage fluidic rectifier 20 of this invention, adjacent guide vanes 50 are asymmetrical.

Curved corner 37 is a blended radius which is extremely important to efficient operation of fluidic rectifier 20 of this invention. If such curved corner 37 or blended radius is not included, flow in the forward or easy direction will experience significantly increased head losses. In the forward or easy direction, without curved corner 37, flow will separate from side wall 32 of trunk channel 30 at the point where it would meet the otherwise sharp edge, and thereby cause an undesirable contraction in the flow area.

The last stage of fluidic rectifier 20, whether a single-stage or a multiple-stage, forms a vacuous cavity slightly downstream of the intersecting flows. Such vacuous cavity is pumped by the mechanism of entrainment, or ejector pump action, and the vacuum generated is substantial. Such vacuum is formed regardless of whether the fluid is gas or liquid. The force of the vacuum acts normal to the free surface, the vacuum/fluid interface, and reduces the amount of jet contraction. If the competing force of the vacuum is destroyed, for example by installing vent 27 or by exposing trunk channel 30 to the atmosphere or ambient, the jet contraction is desirably increased. The head loss ratio of a single-stage fluidic rectifier 20 is increased from about 3.8 to about 4.6 by removing such vacuum region.

EXPERIMENTATION

Figure 13:
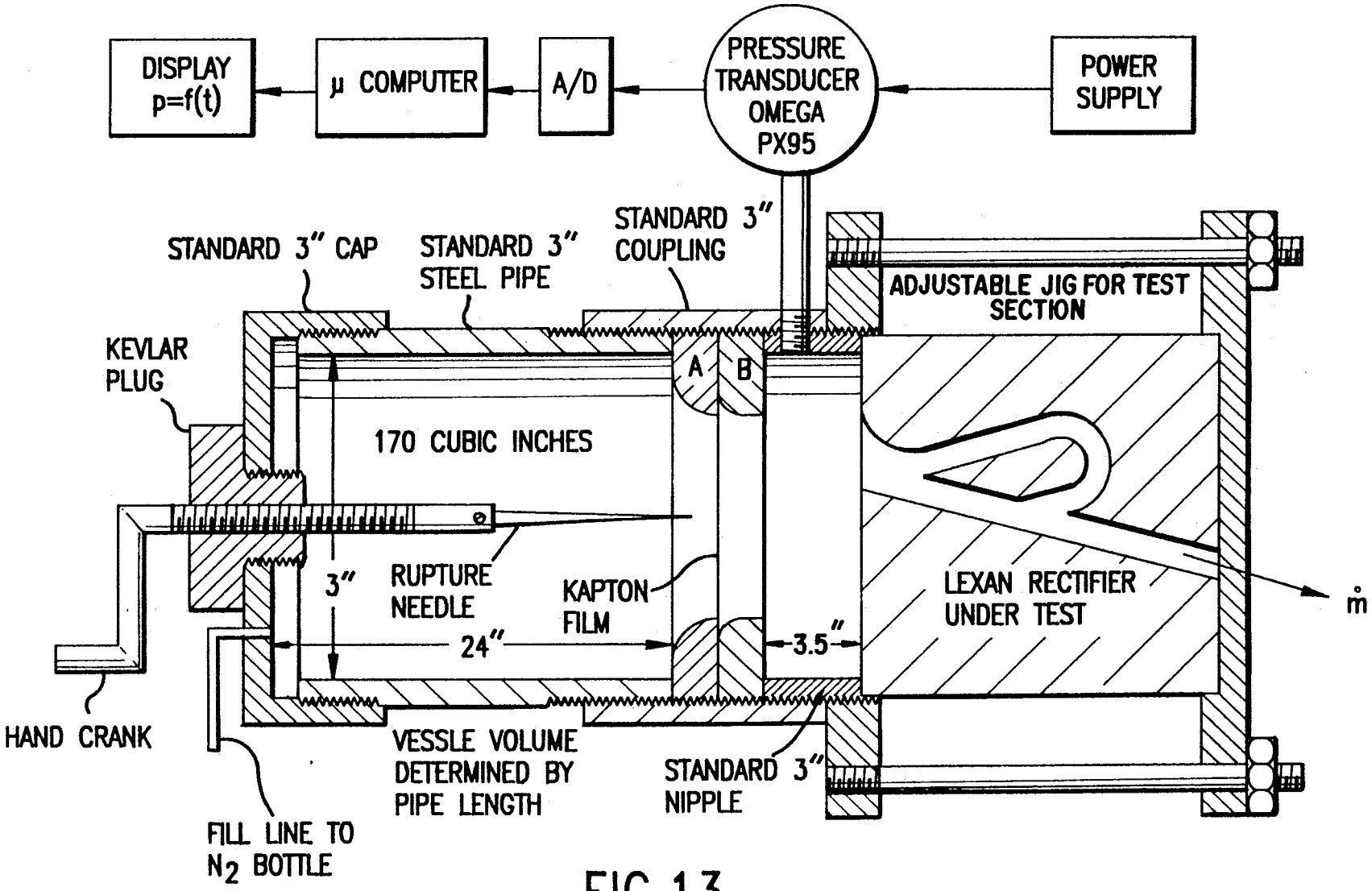
FIG. 13 is a diagrammatic cross-sectional view of a fluidic rectifier, according to this invention, mounted within a testing surge generator.

Considering the transient behavior of fluidic rectifier 20 according to this invention, fluidic rectifier 20 must be capable of checking a rapidly rising pressure surge within a few milliseconds, in order to be effective when used with a pulse combustor. In order to study the response of fluidic rectifier 20 according to this invention, experiments included excitation by a shock tube and the pressure near the base of the valve was recorded every millisecond with a computer-controlled data acquisition system. The experimental set up is shown in FIG. 13.

Three transient tests were conducted. Excitation of the six-stage fluidic rectifier 20 was conducted in both the hard or reverse direction and the easy or forward direction. A "benchmark" test was conducted with a 0.5 inch long by 0.25 inch square bore nozzle which was excited by the shock tube. The short nozzle had a very good discharge coefficient, greater than 0.9, since a bell mouth entrance was used.

The shock tube stored 2.8 laters of dry nitrogen, and was pressurized to 88 psig for each test. The test passageways were attached to a relatively small plenum having a volume of 0.3 liters, which in turn was fed by the shock tube. The plenum and test passageways were maintained at atmospheric pressure. The data acquisition system initiated a pressure recording when it detected a change of pressure from atmospheric. Upon the rupture of a Kapton membrane, a sonic gas surge impacted the passageway under test, and pressure dated near the face of fluidic rectifier 20 was sampled and recorded every millisecond for 0.1 seconds. The passageways were free to discharge into the atmosphere.

The pressure at the face of the nozzle dropped from 88 psig to 86 psig in the first three (3) milliseconds. Such benchmark data was considered to show the behavior of a "pure leak" with a passageway flow area equal to fluidic rectifier 20 under examination. The hammer pressure was not visible in the leak data. The resistance to flow through the nozzle is substantially equal to that of accelerating the mass of the gas from rest to the speed of sound in the short nozzle, wherein the resistance to flow was due to skin friction in the nozzle, as a second order effect.

With flow in the easy or forward direction, pressure at the face of fluidic rectifier 20 rose from 88 psig to 92 psig in the first three (3) milliseconds. Such pressure jump was due to the often-called "hammer pressure". The sonic gas surge was brought to rest on the surface of fluidic rectifier 20, and it "piled up" producing increased pressure. Because of the analogy with water hammer, the propagating shock wave was called a "hammer wave". The damped oscillation visible in the transient data results from the reflection of the hammer wave back and forth within the shock tube.

With flow in the hard or reverse direction, pressure at the face of fluidic rectifier 20 rose from 88 psig to 100 psig in the first three (3) milliseconds. When the hard or reverse direction pressure jump of 12 psig is compared to the easy or forward direction pressure jump of 4 psig, or the 3 psig drop in the case of the pure leak, it can be inferred that fluidic rectifier 20 demonstrated rapid response, and adequately contained pressure energy on a time scale of a few milliseconds.

Data resulting from the tests conducted with fluidic rectifier 20 according to this invention indicates the presence of a beneficial effect upon a pulse combustor. The pulse combustor obtained better vacuum in its recharge portion of the cycle and also obtained higher peak combustion pressures.

An envelope of vibratory excursion of the needle of the mechanical pressure gauge at the intake of fluidic rectifier 20 was an order of magnitude smaller with fluidic rectifier 20 in position. Such observation implies that fluidic rectifier 20 of this invention checks the pulse combustion surge back through the air supply. The air supply line was disconnected and its flow directed upon the intake port of fluidic rectifier 20. Virtually no combustion blowby was detected at such intake port.

Figure 11:
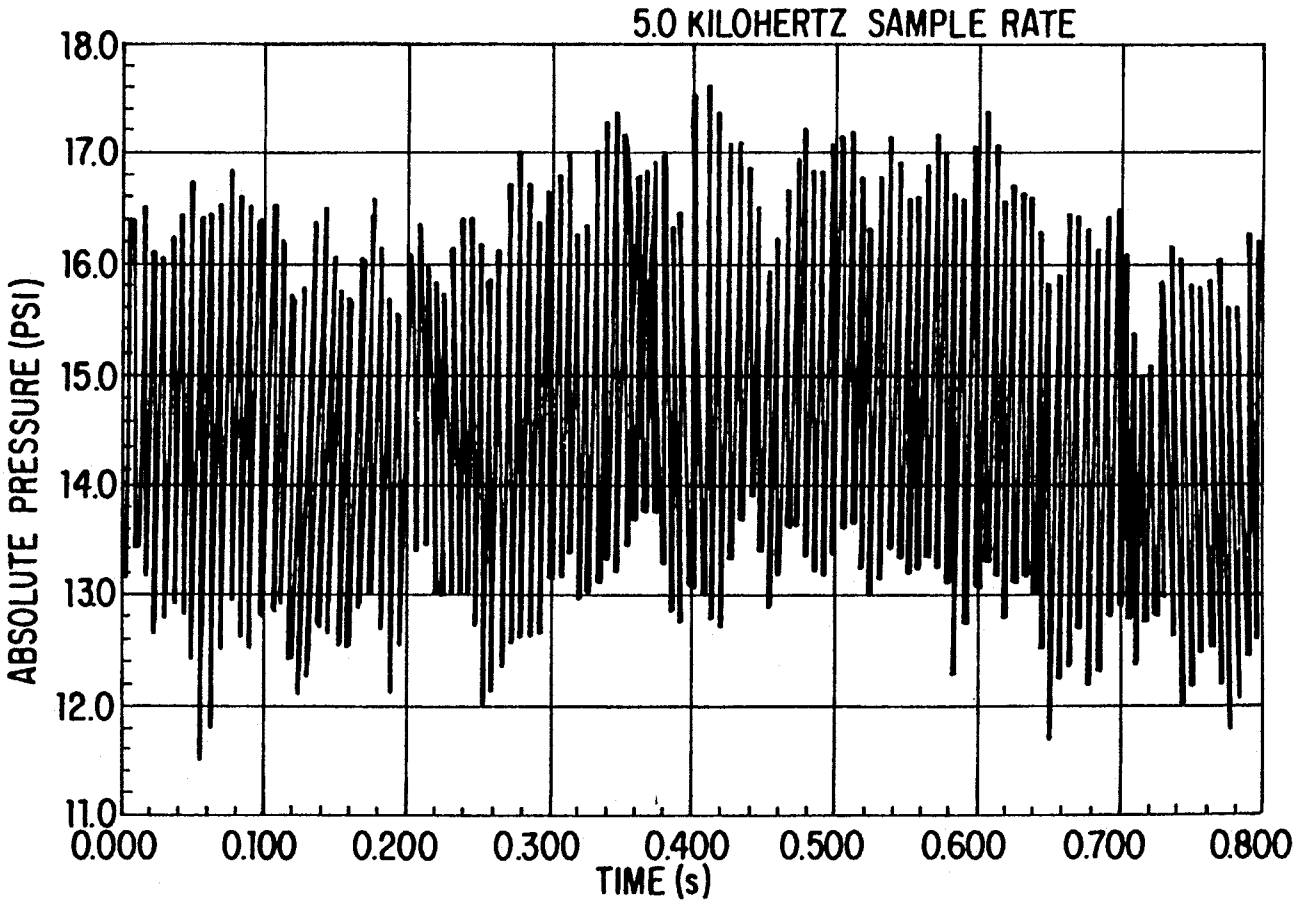
FIG. 11 is a graph showing Absolute Pressure vs. Time results obtained from a test conducted with a fluidic rectifier, according to this invention.

FIG. 11 shows a time history of the pressure oscillation within the pulse combustion chamber with fluidic rectifier 20 installed, with no spark, with air consumption at 141 liters/minute, and with methane consumption at 9 liters/minute. The oscillation was uniform and generally axial. The thrust developed was approximately 168 grams.

If the spark was not disabled, then the uniformity of the oscillation was increased, though the increase in uniformity could not be distinguished in the aural note of the pulse combustor. Such observations indicate that a flame holder or continued spark is beneficial to operation of the pulse combustor.

Figure 12:
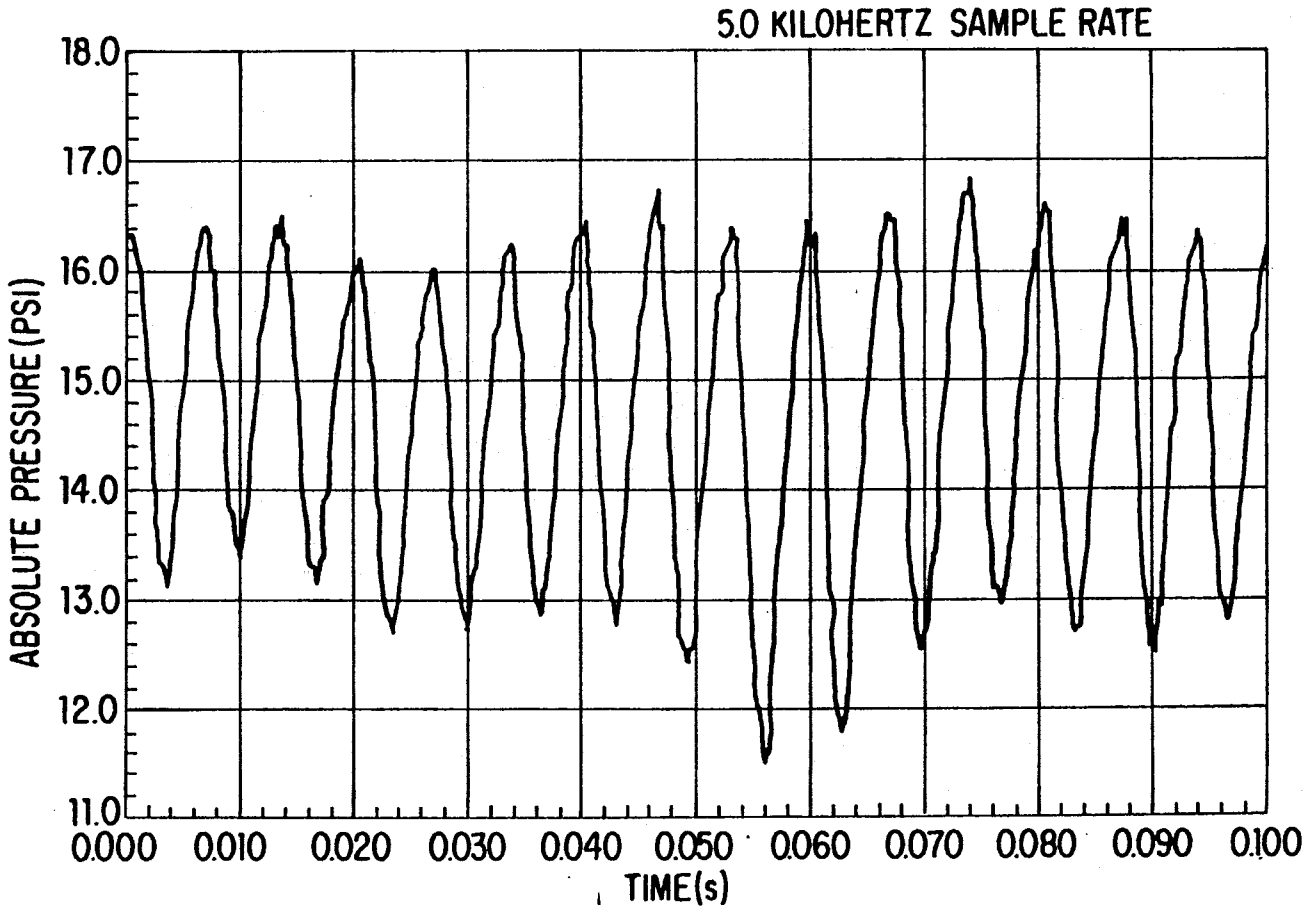
FIG. 12 is a graph showing Absolute Pressure vs. Time results obtained from a test conducted with a fluidic rectifier, according to this invention.

FIG. 12 shows the same data as FIG. 11 but on an expanded time scale.

While in the foregoing specification this invention has been described in relation to certain preferred embodiments thereof, and many details have been set forth for purpose of illustration it will be apparent to those skilled in the art that the invention is susceptible to additional embodiments and that certain of the details described herein can be varied considerably without departing from the basic principles of the invention.

I claim:

1. In a method wherein a fluid entering an inlet of a fluidic rectifier in a reverse direction is divided into trunk flow through a trunk channel and reversing flow through a reversing channel which communicates with said trunk channel at a downstream position of said trunk channel, when said fluid is flowing in said reverse direction said downstream position being downstream with respect to an area where said reversing channel divides from said trunk channel, the improvement comprising the steps of:

(a) forming a first vena contracta upon entry of said fluid within a body defining said trunk channel;

(b) directing said trunk flow through said trunk channel at a first angle ($\alpha$) of approximately 22.5° measured clockwise from a 0° rectilinear axis of rectilinear flow entering said inlet;

(c) directing said reversing flow through a converging cross-sectional area straight section of said reversing channel;

(d) further directing said reversing flow through a curved section of said reversing channel such that said reversing flow impinges said trunk flow at a second angle ($\beta$) of approximately 157.5° measured clockwise from said 0° rectilinear axis; and (e) forming a second vena contracta in a contracta area of said trunk channel where said reversing flow impinges said trunk flow.

2. In a method according to claim 1 further comprising the steps of downstream from a discharge of said first curved section of said first reversing channel, directing a first portion of first impinged fluid through a second trunk channel at a third angle ($\gamma$) of approximately 22.5° measured counterclockwise from said 0° rectilinear axis;

directing a remaining portion of said first impinged fluid through a constant cross-sectional area straight section of said second reversing channel;

further directing said remaining portion of said first impinged fluid through a second curved section of said second reversing channel such that said remaining portion of said first impinged fluid impinges said first portion of said first impinged fluid at a fourth angle ($\delta$) of approximately 157.5° measured counterclockwise from said 0° rectilinear axis; and forming a third vena contracta in a second contracta area where said remaining portion of said first impinged fluid impinges said first portion of said first impinged fluid.

3. In a fluidic rectifier having a body with a trunk channel and a reversing channel that joins said trunk channel at a downstream position of said trunk channel, when fluid is flowing in a reverse direction through said fluidic rectifier said downstream position being downstream with respect to a division of said reversing channel from said trunk channel, the improvement comprising:

first means for forming a first vena contracta upon entry of said fluid into said body, when said fluid is flowing in said reverse direction;

second means for forming a second vena contracta within said trunk channel whereby reversing flow of said fluid discharged from said reversing channel impinges upon and contracts trunk flow of said fluid through said trunk channel; and disablement means for disabling said first vena contracta and said second vena contracta when said fluid flows in a forward direction through said fluidic rectifier.

4. In a fluidic rectifier according to claim 3 wherein said second means comprise: a trunk axis of said trunk channel positioned at a first angle ($\alpha$) of approximately 22.5° measured clockwise from a 0° rectilinear axis, said 0° rectilinear axis being parallel to a direction of rectilinear flow entering said fluidic rectifier in said reverse direction, a straight section of said reversing channel having a converging cross-sectional area in a downstream reverse direction, and a discharge portion of a curved section of said reversing channel intersecting said trunk channel whereby said discharged reversing flow impinges said trunk flow within said trunk channel at a second angle ($\beta$) of approximately 157.5° measured clockwise from said 0° rectilinear axis.

5. In a fluidic rectifier according to claim 4 wherein a cross section of said straight section is rectangular and an inner side wall and an opposing outer side wall of said straight section converge as far as said curved section at an included angle of approximately 3.8°.

6. In a fluidic rectifier according to claim 5 wherein said inner side wall is positioned at a third angle of approximately 163.77° measured clockwise from said 0° rectilinear axis and said outer side wall is positioned at a fourth angle of approximately 167.57° measured clockwise from said 0° rectilinear axis.

7. In a fluidic rectifier according to claim 4 wherein said second means further comprise: a guide vane positioned between said reversing channel and said trunk channel, and said guide vane having a sharp leading edge presented into said fluid flowing in said reverse direction and forming an included angle of approximately 38.0°.

8. In a fluidic rectifier according to claim 7 wherein said guide vane is a portion of said body.

9. In a fluidic rectifier according to claim 4 wherein said curved section of said reversing channel is approximately as wide as said trunk channel.

10. In a fluidic rectifier according to claim 9 wherein said curved section has a constant mean radius of curvature approximately 1.5 times a width of said trunk channel.

11. In a fluidic rectifier according to claim 4 further comprising: said body having a vent in communication with ambient and said trunk channel, and said vent positioned within said trunk channel downstream of an intersection between an outer side wall of said reversing channel and a side wall of said trunk channel and positioned near said second vena contracta.

12. In a fluidic rectifier according to claim 4 wherein said disablement means comprise said trunk channel having a rectangular cross section and opposing side walls of said trunk channel form a rounded outlet in a downstream area where said trunk channel exits said body.

13. In a fluidic rectifier according to claim 4 wherein said trunk channel and said reversing channel each have a rectangular cross section.

14. In a fluidic rectifier according to claim 3 wherein said second means comprise a guide vane positioned between said trunk channel and said reversing channel, said guide vane has a sharp leading edge dividing said fluid flowing in said reverse direction into trunk flow through said trunk channel in a trunk mass flow amount and reversing flow through said reversing channel in a reversing mass flow amount such that trunk momentum of said trunk flow and reversing momentum of said reversing flow create maximum contraction of said trunk flow at an area of impingement of said reversing flow against said trunk flow.

15. In a fluidic rectifier according to claim 3 wherein said first means comprise said body having a sharp edged rectangular aperture positioned in a plane of an external face of said body whereby in said reversing direction said fluid enters said body in a direction approximately normal to said sharp edged rectangular aperture to form said first vena contracta.

16. In a fluidic rectifier according to claim 15 wherein said sharp edged rectangular aperture is defined at an intersection of said external face and an internal walls of said body which define said trunk channel.

17. In a fluidic rectifier according to claim 3 further comprising third means for forming a third vena contracta in a third contracta area of a second trunk channel where a reversing portion of first impinged said fluid impinges a third portion of said first impinged fluid.

18. In a fluidic rectifier according to claim 17 wherein:

said second means comprise a first trunk axis of said trunk channel positioned at a first angle ($\alpha$) of approximately 22.5° measured clockwise from a 0° rectilinear axis, said 0° rectilinear axis being parallel to a direction of rectilinear flow entering said fluidic rectifier in said reverse direction, a first straight section of said first reversing channel having a converging cross-sectional area in a downstream reverse direction, and a first discharge portion of a first curved section of said first reversing channel intersecting said first trunk channel whereby first discharged reversing flow impinges said trunk flow within said first trunk channel at a second angle ($\beta$) of approximately 157.5° measured clockwise from said 0° rectilinear axis; and said third means comprise a second reversing channel having a second straight section, said second straight section having a second straight section axis rectilinearly aligned with said first trunk axis of said first trunk channel, and a second axis of said second trunk channel positioned at a third angle of ($\delta$) approximately 157.5° measured counterclockwise from said 0° rectilinear axis.

19. In a fluidic rectifier according to claim 18 wherein said second straight section of said second reversing channel has a constant cross section.

20. In a fluidic rectifier according to claim 18 wherein said third means further comprise: a guide vane positioned between said second reversing channel and said second trunk channel, and said guide vane having a sharp leading edge presented into said fluid flowing in said reverse direction and forming an included angle of approximately 45.0°.

21. In a fluidic rectifier according to claim 20 wherein said guide vane is a portion of said body.

22. In a fluidic rectifier according to claim 18 wherein said second reversing channel is approximately as wide as said second trunk channel.

23. In a fluidic rectifier according to claim 22 wherein second curved section of said second reversing channel has a constant mean radius of curvature approximately 1.5 times a width of said second trunk channel.

24. In a fluidic rectifier according to claim 18 wherein said second trunk channel has a rectangular cross section and opposing side walls of said second trunk channel form a rounded outlet in a downstream area where said second trunk channel exits said body.

25. In a fluidic rectifier according to claim 18 wherein said second trunk channel and said second reversing channel each have a rectangular cross section.

26. In a fluidic rectifier according to claim 17 wherein said third means comprise a guide vane positioned between said second trunk channel and said second reversing channel, said guide vane having a sharp leading edge dividing said fluid flowing in said reverse direction into second trunk flow through said second trunk channel in a trunk mass flow amount and reversing flow through said second reversing channel in a reversing mass flow amount such that trunk momentum of said second trunk flow and reversing momentum of said second reversing flow create maximum contraction of said second trunk flow at an area of impingement of said second reversing flow against said second trunk flow.

27. In a fluidic rectifier according to claim 17 wherein said first means comprise said body having a sharp edged rectangular aperture positioned in a plane of an external face of said body whereby in said reversing direction said fluid enters said body in a direction approximately normal to said sharp edged rectangular aperture to form said first vena contracta.

28. In a fluidic rectifier according to claim 27 wherein said sharp edged rectangular aperture is defined at an intersection of said external face and an internal walls of said body which define said first trunk channel.

29. In a fluidic rectifier according to claim 3 wherein said disablement means comprise a discharge portion of said reversing channel and downstream and adjacent portion of said trunk channel intersecting to form a curved corner.

30. In a fluidic rectifier according to claim 17 further comprising fourth means for forming a fourth vena contracta in a fourth contracta area of a third trunk channel where a reversing portion of second impinged said fluid impinges a fourth portion of said second impinged fluid.

31. In a fluidic rectifier according to claim 30 wherein:

said second means comprise a first trunk axis of said trunk channel positioned at a first angle ($\alpha$) of approximately 22.5° measured clockwise from a 0° rectilinear axis, said 0° rectilinear axis being parallel to a direction of rectilinear flow entering said fluidic rectifier in said reverse direction, a first straight section of said first reversing channel having a converging cross-sectional area in a downstream reverse direction, and a first discharge portion of a first curved section of said first reversing channel intersecting said first trunk channel whereby first discharged reversing flow impinges said trunk flow within said first trunk channel at a second angle ($\beta$) of approximately 157.5° measured clockwise from said 0° rectilinear axis;

said third means comprise a second reversing channel having a second straight section, said second straight section having a second straight section axis rectilinearly aligned with said first trunk axis of said first trunk channel, and a second axis of said second trunk channel positioned at a third angle ($\delta$) of approximately 157.5° measured counterclockwise from said 0° rectilinear axis; and said fourth means comprise a third reversing channel having a third straight section, said third straight section having a third straight section axis rectilinearly aligned with said second trunk axis of said second trunk channel, and a third axis of said third trunk channel positioned at a fourth angle ($\alpha$) of approximately 22.5° measured clockwise from said 0° rectilinear axis.

32. In a fluidic rectifier according to claim 31 wherein said third trunk channel has a rectangular cross section and opposing side walls of said third trunk channel form a rounded outlet in a downstream area where said third trunk channel exits said body.

33. In a fluidic rectifier according to claim 30 wherein said fourth means comprise a guide vane positioned between said third trunk channel and said third reversing channel, said guide vane having a sharp leading edge dividing said fluid flowing in said reverse direction into third trunk flow through said third trunk channel in a trunk mass flow amount and reversing flow through said third reversing channel in a reversing mass flow amount such that trunk momentum of said third trunk flow and reversing momentum of said third reversing flow create maximum contraction of said third trunk flow at an area of impingement of said third reversing flow against said third trunk flow.

34. In a fluidic rectifier having a plurality of stages wherein said fluidic rectifier has a body with a trunk channel and a reversing channel at each said stage, said reversing channel joining said trunk channel at a downstream position of said trunk channel, when fluid is flowing in a reverse direction through said fluidic rectifier said downstream position being downstream with respect to an area where said reversing channel divides from said trunk channel, the improvement comprising:

first means for forming a first vena contracta upon entry of said fluid into said body, when said fluid is flowing in said reverse direction first means for forming a first vena contracta in a first contracta area of a first said trunk channel where said reversing flow first impinges said trunk flow; and second means for forming a second vena contracta in a second contracta area of a second said trunk channel where a reversing portion of first impinged said fluid impinges a core portion of said first impinged fluid.

* * * * *